United States Patent [19]

Saitoh et al.

[11] Patent Number: 4,530,494

[45] Date of Patent: Jul. 23, 1985

[54] AUTO COPY-PAPER SELECTOR

[75] Inventors: Kiyonobu Saitoh, Nara, Japan; Katsuyoshi Fujiwara, Osaka, both of Japan

[73] Assignee: Sharp Kabushiki Kaisha, Osaka, Japan

[21] Appl. No.: 483,532

[22] Filed: Apr. 11, 1983

[30] Foreign Application Priority Data

Apr. 15, 1982 [JP] Japan ..... 57-63261
Apr. 15, 1982 [JP] Japan ..... 57-63262

[51] Int. Cl.[3] ..... B65H 3/44
[52] U.S. Cl. ..... 271/9; 271/164
[58] Field of Search ..... 271/9, 157, 159, 162, 271/164

[56] References Cited

U.S. PATENT DOCUMENTS 3,977,666 8/1976 Suzuki ..... 271/164 X
4,386,769 6/1983 Ito ..... 271/159 X

*Primary Examiner*—Richard A. Schacher
*Attorney, Agent, or Firm*—Birch, Stewart, Kolasch & Birch

[57] ABSTRACT

An auto paper selector suitable for a copying machine comprises a first and second paper supply sections to which a first and second cassettes storing papers are attached, respectively, a first and second paper extracting devices for extracting the papers from the first and second cassettes, respectively, the first and second paper extracting devices being positioned at the first and second paper supply sections, respectively, and a selecting circuit responsive to the new attachment of either the first cassette or the second cassette for activating either the first paper extracting device or the second paper extracting device, respectively.

4 Claims, 7 Drawing Figures

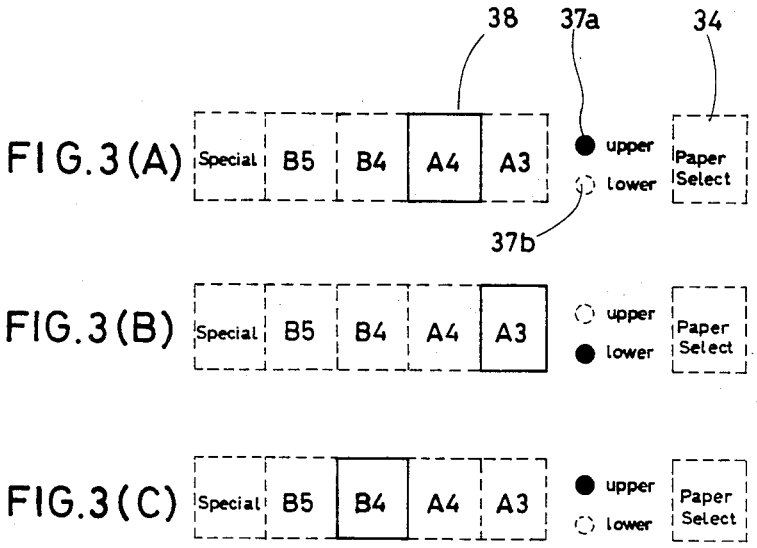
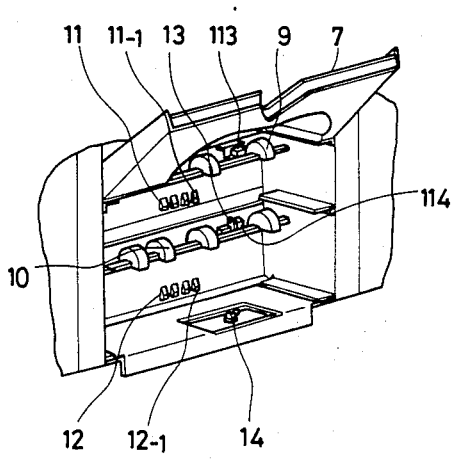
FIG.4

AUTO COPY-PAPER SELECTOR

BACKGROUND OF THE INVENTION

The present invention relates to a paper supplier for a copying machine and, more particularly, to an auto copypaper selector for a copying machine.

Conventional paper suppliers for supplying papers to electrophotographic copying machines are activated by attaching thereto several cassettes each containing a great number of papers. The cassettes store the papers of different sizes, respectively. The electrophotographic copying machines select the sizes of the papers by selecting among the cassettes in copying documents.

Conventionally, the selection of the paper size is enabled by having to operate a switch for selecting the paper sizes, the switch being provided on the copying machine, after the cassette storing suitable papers is exchanged and attached to the copying machine.

When the exchanged cassette is related to the paper size as previously selected by the selection switch, the exchanged cassette can be selected to copy a document on a suitable paper even if the selection switch is not operated. However, when the exchanged cassette is not related to the paper size as previously selected by the selection switch and the selection switch is not operated, the exchanged cassette cannot be selected to copy the document on the suitable paper.

Thus, it is troublesome to have to operate the selection switch after the cassette is exchanged.

SUMMARY OF THE INVENTION

Accordingly, it is an object of the present invention to, provide an improved paper supplier for a copying machine.

It is another object of the present invention to provide a novel auto copy-paper selector for a copying machine.

It is a further object of the present invention to provide an improved paper selector for a copying machine, the paper selector being operated upon the exchange of a paper cassette storing papers.

Briefly described, in accordance with the present invention, an auto paper selector suitable for a copying machine comprises first and second paper supply sections to which first and second cassettes storing papers are attached, respectively, a first and second paper extracting means for extracting the papers from the first and second cassettes, respectively, the first and second paper extracting means being positioned at the first and second paper supply sections, respectively, and selecting means responsive to the new attachment of either the first cassette or the second cassette for activating either the first paper extracting means or the second paper extracting means, respectively.

BRIEF DESCRIPTION OF THE DRAWINGS

The present invention will become more fully understood from the detailed description given hereinbelow and accompanying drawings which are given by way of illustration only, and thus are not limitative of the present invention and wherein:

FIGS. 3(A) to 3(C) show examples of displaying paper switching operations by the paper switching board of FIG. 2;

FIG. 4 shows a perspective view of a paper supply section for the auto paper selector of the invention.

DESCRIPTION OF THE INVENTION

Figure 1:
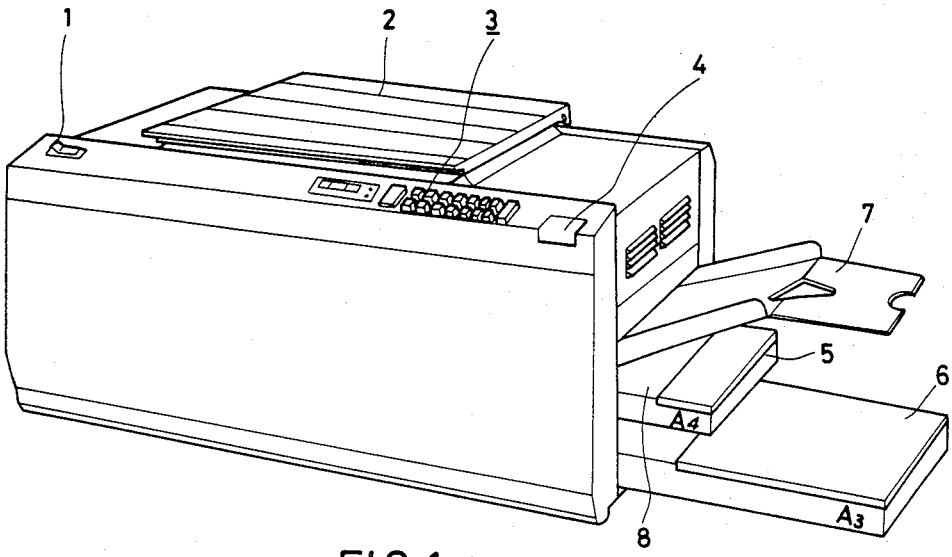
FIG. 1 shows a perspective view of a xerographic copying machine equipped with an auto paper selector according to the present invention.

FIG. 1 shows an electrophotographic copying machine equipped with an auto paper selector according to the present invention. The electrophotographic copying machine comprises a power switch 1, a document cover 2, a paper switching board 3, a copy switch 4, a first paper cassette 5, a second paper cassette 6, and a paper receiving tray 7.

The power switch 1 is actuated to turn power on and off for the copying machine. The document cover 2 is provided for covering a document disposed on a transparent glass plate. The paper switching board 3 is actuated to select copy papers. The copy switch 4 is actuated to initiate the copying of a document. The first paper cassette 5 is positioned at an upper section. The second paper cassette 6 is positioned at a lower section. The paper receiving tray 7 is provided for receiving a copied paper output by the copying machine.

Figure 2:
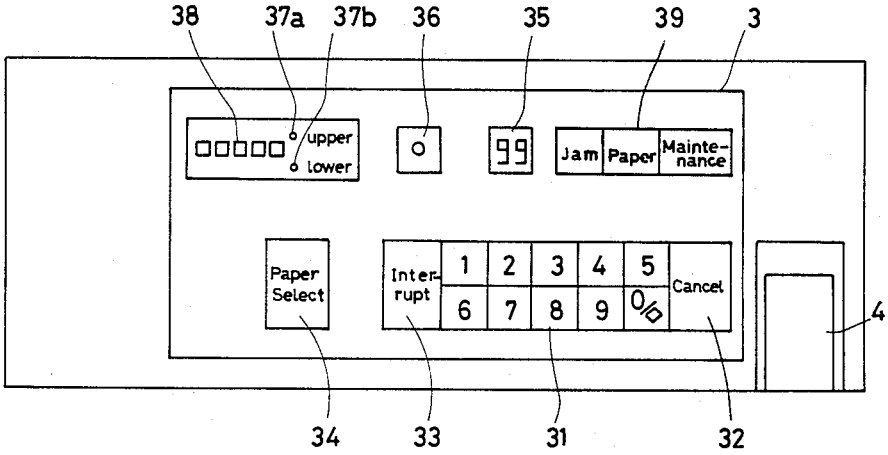
FIG. 2 shows a plan view of a paper switching board provided on the copying machine of FIG. 1.

FIG. 2 shows the paper switching board 3 in a plan view. The board 3 includes digit keys 31, a cancel key 32, an interrupt key 33, a paper select key 34, a display 35, a lamp 36, two selection lamps **37*a* and 37*b*, a size display 38, and an alarm display 39**.

The digit keys 31 are actuated to set the number of copies to be made. The cancel key 32 is operated to cancel set information including the number of copies to be made. The interrupt key 33 is operated to allow copy interruption. The paper select key 34 is operated to select either the first paper cassette 5 or the second paper cassette 6.

The dipslay 35 displays the number of copies to be made. The lamp 36 is illuminated while the copy interruption takes place by operating the interruption key 33. The two selection lamps **37*a* and 37*b* are operated in conjuction with the paper select key 34. The first selection lamp 37*a* is illuminated while the first paper cassette 5 is selected. The second selection lamp 37*a* is illuminated while the second paper cassette 6 is selected. The size display 38** displays the sizes of the papers selected.

The alarm display 39 comprises three lamps each illuminated to indicate that a paper is jammed during its travelling, that the cassette becomes empty, and that some maintenance is required.

FIGS. 3(A) to 3(C) show examples of displaying paper switching operations by the size display 38, the two selection lamps **37*a* and 37*b* in conjunction with the operation of the paper select key 34**.

FIG. 3(A): Assuming that the second cassette 6 as positioned at the lower section is selected, the paper select key 34 is once operated so that the first cassette 5 as positioned at the upper section is selected. The first selection lamp **37*a* becomes illuminated. When the first cassette 5 contains the A4 size papers, an A4 size lamp in the size display 38** is illuminated.

FIG. 3(B): Following the selection of FIG. 3(A), the paper select key 34 is further operated so that the second cassette 6 is selected, again and the second selection lamp **37*b*** becomes illuminated. When the second cassette 6 contains the A3 size papers, an A3 size lamp in the size display 38 becomes illuminated.

FIG. 3(C): In this case, the first cassette 5 is selected to illuminate the first selection lamp 37*a* and a B4 size lamp in the size display 38 according to the paper size of the first cassette 5.

In this manner, one of the cassettes can be selected.

FIG. 4 shows a paper supply section for the auto paper selector of the present invention. The paper supply section has upper and lower sections. At the upper section, paper supply rollers 9 are positioned to confront the first cassette 5. At the lower section, paper supply rollers 10 are positioned to confront the second cassette 6. Each of the paper supply rollers 9 and 10 is rotated one turn with the help of a one-turn mechanism to thereby forward one of the papers from the cassette to a forwarding roller in the copying machine. The one-turn mechanism is activated by selecting solenoid means.

In front of the cassette positions, two sets of three sensors 11 and 12 are provided for sensing the paper sizes as stored in the cassettes. Each of the three sensors 11 and 12 is pressed by projections provided at the cassettes, the projections corresponding to the paper sizes of the cassettes, to detect the paper sizes. Upper and lower sensors 11-1 and 12-1 are provided for detecting the attachment of the cassettes 5 and 6. A set of three sensors 11 or 12 can identify in combination 8 different paper sizes.

To detect the presence of at least one paper in one of the cassettes 5 and 6 as positioned, a light emitting element 13 or 14 and a light receiving element 113 or 114 are confronted to sandwich the cassette 5 or 6. Each of the cassettes 5 and 6 has a window for passing the light emitted from the light emitting elements 13 and 14 toward the light receiving elements 113 and 114. The window is closed by the paper when the paper is positioned inside the cassette 5 or 6. When one of the light receiving elements 113 or 114 detects respective light from the light emitting elements 13 or 14, the absence of paper in the cassette 5 or 6 is detected. The "PAPER" lamp in the alarm display 39 becomes illuminated when the selected cassette becomes empty. When the selected cassette is not empty and the unselected cassette is empty, the "PAPER" lamp in the alarm display 39 is not illuminated.

Using the above-described paper supply section, the copy switch 4 is operated to copy a document after the paper select key 34 is actuated to select a desired one of the first cassette 5 or the second cassette 6 and the size display 38 displays the selected paper size.

According to the present invention, an auto paper selector is provided to enable that, when a new cassette replaces another, the presently exchanged cassette is automatically selected to supply the papers toward the copying machine without specifically selecting this cassette.

Figure 5:
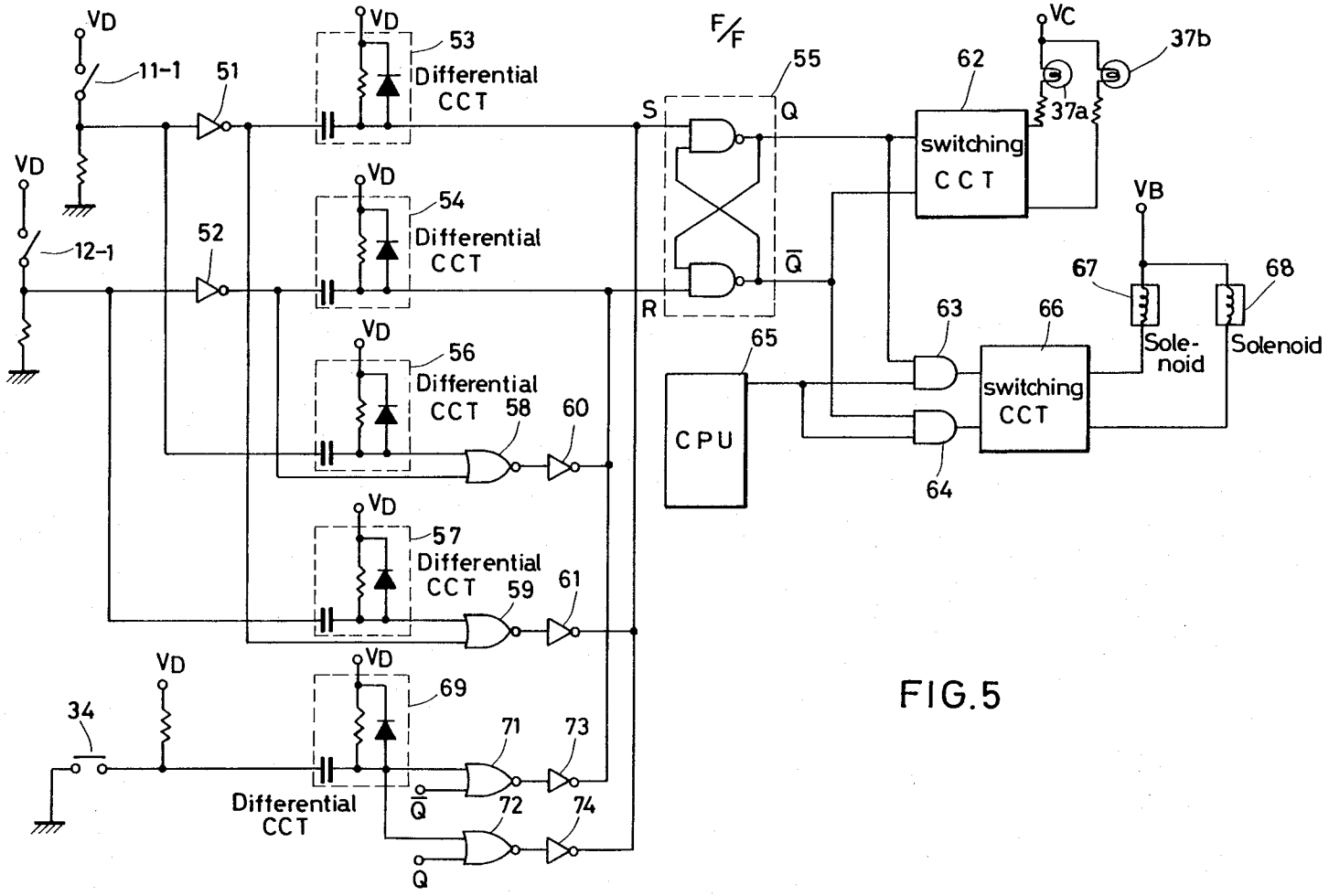
FIG. 5 shows a block diagram of a selection circuit for operating the auto paper selector of the present invention.

FIG. 5 shows a block diagram of a selection circuit for operating the auto paper selector of the present invention. The selection circuit mainly comprises five differential circuits 53, 54, 56, 57 and 69, a flip-flop 55, a CPU 65, and two switching circuits 62 and 66.

The sensors 11-1 and 12-1 are provided for detecting the attachment of the cassettes 5 and 6, as stated above. The sensors 11-1 and 12-1 are grounded via resistors and biased with a power source of VD. The connection between the sensor 11-1 and the resistor is connected to an inverter 51. The output terminal of the inverter 51 is connected to a set terminal S of the flip-flop 55 via the differential circuit 53. The connection between the sensor 12-1 and the resistor is connected to an inverter 52. The output terminal of the inverter 52 is connected to a reset terminal R of the flip-flop 55 via the differential circuit 54. The flip-flop 55 comprises two NAND gates.

The connection between the sensor 11-1 and the resistor is also connected to an input terminal of an NOR gate 58 via the differential circuit 56. The output terminal of the inverter 52 is connected to the other input terminal of the NOR gate 58. The connection between the sensor 12-1 and the resistor is also connected to an input terminal of an NOR gate 59 via the differential circuit 57. The output terminal of the inverter 51 is connected to the other input terminal of the NOR gate 59.

The output terminal of the NOR gate 58 is connected to the reset terminal R of the flip-flop 55 via an inverter 60. The output terminal of the NOR gate 59 is connected to the set terminal S of the flip-flop 55 via an inverter 61.

Responsive to set and reset input signals, the flip-flop 55 generates set output signals Q and reset output signals $\overline{Q}$ applied to the switching circuit 62 to illuminate the two selection lamps 37*a* and 37*b*. The set output signals Q are also entered to an AND gate 63. The reset output signals $\overline{Q}$ are also entered to an AND gate 64. The CPU 65 is provided for generating paper extracting signals to the AND gates 63 and 64. The CPU 65 is installed within the body of the copying machine. Through the AND gates 63 and 64, the paper extracting signals are applied to the switching circuit 66 to activate two solenoids 67 and 68, so that the paper supply rollers 9 and 10 are rotated once. The solenoid 67 is activated for rotating the upper paper supply rollers 9. The solenoid 68 is activated for rotating the lower paper supply rollers 10. When the AND gate 63 passes the paper extracting signals toward the switching circuit 66, the solenoid 67 is activated. When the AND gate 64 passes the paper extracting signals toward the switching circuit 66, the solenoid 68 is activated.

This circuit arrangement of FIG. 5 provides the following auto paper selections:

When the flip-flop 55 is set, the upper paper supply rollers 9 are activated to extract the papers from the upper and first cassette 5. When the flip-flop 55 is reset, the lower paper supply rollers 10 are activated to extract the papers from the lower and second cassette 6. The upper sensor 11-1 detects the new attachment of the cassette 5, so that the differential circuit 53 generates trigger signals (differential signals)to set the flip-flop 55 to thereby select the newly attached cassette 5. When the lower sensor 12-1 detects the new attachment of the cassette 6, the differential circuit 54 outputs the trigger signals to reset the flip-flop 55 to thereby select the newly attached cassette 6.

The NOR gates 58 and 59 are provided for detecting the removal of the cassette 5 and 6 from the paper supply section. When one of the cassettes is removed, the other cassette is automatically selected.

To select one of the cassettes 5 or 6 as attached to the paper supply section by operating the paper select key 34, a terminal of the paper select key 34 is grounded and the other terminal thereof is biased with the power source of $V_D$. The other terminal of the paper select key 34 is connected to two NOR gates 71 and 72 via the differential circuit 69. The set output signals Q and the reset output signals $\overline{Q}$ from the flip-flop 55 are applied to the NOR gates 72 and 71, respectively.

The output terminal of the NOR gate 71 is connected to the reset terminal R of the flip-flop 55 via an inverter 73. The output terminal of the NOR gate 72 is connected to the set terminal S of the flip-flop 55 via an inverter 74.

Thus, once the paper select key 34 is operated, the NOR gate 71 outputs the reset signals when the upper and first cassette 5 has been selected. Hence, the flip-flop 55 becomes reset to select the lower and second cassette 6. The four inverters 60, 61, 73 and 74 are of open collector types. They block high level signals, "H" and pass low level signals, "L" toward the set and reset terminals of the flip-flop 55.

To display the paper size of the cassette as described with reference to FIG. 4, the sensors 11 and 12 output detection signals to illuminate the corresponding lamps of the size display 38. Such a circuit is not shown in the circuit of FIG. 5. When the upper and first cassette 5 is selected, the detection signals from the lower sensors 12 are neglected and the detection signals from the upper sensors 11 are used to illuminate the size lamps.

The circuit operation of FIG. 5 will be further described below.

Mode I [A single cassette is attached]:

Assuming that no cassette has been attached to the paper supply section of the copying machine, the cassette 5 storing the A4 size papers on which some documents are to be copied is attached to the upper paper supply section.

Responsive to the new attachment of the first cassette 5, the upper sensor 11-1 is activated, so that the output signal of the inverter 51 is changed from the high level signal "H" to the low level signal "L". Responsive to this, the differential circuit 53 outputs the differential signal toward the set terminal S of the flip-flop 55 to set the flip-flop 55, so that the set output signal Q of the flip-flop 55 is made high.

The set output signal Q of "H" is applied to the switching circuit 62 to illuminate the first selection lamp 37*a*, indicating that the upper and first cassette 5 is selected. Since the upper and first cassette 5 is selected, the detection signals from the sensors 11 are made effective to illuminate the A4 size lamp as shown in FIG. 3(A).

The set output signal Q of "H" from the flip-flop 55 permits the AND gate 63 to become conductive so as to activate the solenoid 67 for rotating the upper paper supply rollers 9. Once the operator actuates the copy switch 4, a copy operation starts, so that the CPU 65 outputs the paper extracting signals in synchronization with the rotation of a photosensitive drum. Responsive to the paper extracting signals, the AND gate 63 is conductive to thereby activate the solenoid 67 via the switching circuit 66. The upper paper supply rollers 9 are rotated a full turn, so that an A4 size paper is extracted from the upper and first cassette 5. The paper extracting operations are repeated each time the paper extracting signals are outputted from the CPU 65.

Mode II [Two cassettes are attached]:

Assuming that the first cassette 5 storing the A4 size papers has been attached to the upper paper section, the second cassette 6 storing the A3 size papers is newly attached to the lower paper section and selected to supply the A3 size papers.

Responsive to the new attachement of the second cassette 6, the lower sensor 12-1 is activated, so that the output signal of the inverter 52 is changed from "H" to "L". Responsive to this, the differential circuit 54 outputs the differential signal toward the reset terminal R of the flip-flop 55 to reset the flip-flop 55, so that reset output signal $\overline{Q}$ of the flip-flop 55 is made high.

The reset output signal $\overline{Q}$ of "H" is applied to the switching circuit 62 to illuminate the second selection lamp 37*b*. The detection signals from the sensors 12 are made effective to illuminate the A3 size lamp as shown in FIG. 3(B). The reset output signal $\overline{Q}$ of "H" from the flip-flop 55 permits the AND gate 64 to become conductive so as to activate the solenoid 68 for rotating the lower paper supply rollers 10. Once the operator actuates the copy switch 4, a copy operation starts, so that the CPU 65 outputs the paper extracting signals toward the AND gate 64. The AND gate 64 is conductive to thereby activate the solenoid 68.

The lower paper supply rollers 10 are rotated a full turn, so that an A3 size paper is extracted from the lower and second cassette 6.

To copy some documents on the A4 size papers as stored in the upper and first cassette 5, the paper select key 34 is actuated once to select the upper and first cassette 5. When the paper select key 34 is actuated, the differential circuit 69 outputs the differential signal of "L" toward the NOR gates 71 and 72. Since the lower and second cassette 6 is selected, the flip-flop 55 is reset to thereby output the reset output signal $\overline{Q}$ of "H" toward the NOR gate 71 and output the set output signal Q of "L" toward the NOR gate 72. Then, the NOR gate 72 provides an output signal of "H", so that the inverter 74 provides an output signal of "L".

Therefore, the flip-flop 55 becomes set to enable the display of FIG. 3(A). Thus, the upper and first cassette 5 is selected.

When the paper select key 34 is further actuated, the lower and second cassette 6 is reselected.

Mode III [the auto paper selections]:

Assuming that the first cassette 5 storing the A4 size papers has been attached to the upper paper supply section and the second cassette 6 storing the A3 size papers has been attached to the lower paper supply section and that the second cassette 6 has been selected to supply the A3 size papers, a new cassette storing the B4 size papers is attached to be selected to supply the B4 size papers for copying. The new cassette must replace either the first cassette 5 or the second cassette 6.

(I) When the non-selected first cassette 5 is removed:

When the upper and first cassette 5 is removed from the upper paper supply section, the input signal of the differential circuit 56 is changed from "H" to "L". The differential circuit 56 provides a differential signal of "L" toward the input terminal of the NOR gate 58. The output signal of "L" from the inverter 52 is applied to the other input terminal of the NOR gate 58. Thus, the two input signals of the NOR gate 58 are "L", so that the NOR gate 58 provides an output signal of "H". The inverter 60 provides an output signal of "L" to reset the flip-flop 55. The reset condition of the flip-flop 55 is maintained.

The new cassette storing the $B_4$ size papers replaces the first cassette 5 in the upper paper supply section, so that the sensor 11-1 is actuated. Responsive to the actuation of the sensor 11-1, the output signal of the inverter 51 changes into "L", so that the differential signal of the differential circuit 53 is entered into the set terminal S of the flip-flop 55 to set it. Thus, the new cassette attached to the upper supply section is selected to supply the $B_4$ size papers. The paper select key 34 does not need to be actuated.

(II) When the previously selected second cassette 6 is removed:

The lower and second cassette 6 storing the $A_3$ size papers which has been selected is replaced by the new cassette storing the $B_4$ size papers. In this case, the flip-flop 55 is reset. When the second cassette 6 is removed from the lower paper supply section, the input signal of the differential circuit 57 changes from "H" to "L". The differential circuit 57 provides a differential signal of "L" into the NOR gate 59. The output signal of "L" from the inverter 51 related to the upper paper supply section is inputted into the NOR gate 59. The NOR gate 59 provides an output signal of "H". The inverter 61 provides an output signal of "L", so that the flip-flop 55 is reset. Thus, the remaining upper and first cassette 5 is automatically selected to supply the A4 size papers without operating the key 34, so that the display of the size display 38 is changed to be related to the upper and first cassette 5.

When the new cassette storing the $B_4$ size papers is attached to the lower paper supply section, the output signal of the inverter 52 changes from "H" to "L". The differential circuit 54 causes the flip-flop 54 to become reset. Then, the lower and new cassette is selected to supply the $B_4$ size papers.

According to the present invention, whichever of the upper and first cassette 5 or the lower and second cassette 6 is selected, the newly exchanged cassette is necessarily selected to supply the stored papers without selecting the exchanged cassette by operating the paper select key 34.

According to a specific form of the present invention, when one of the cassettes is removed from the paper supply section, the remaining cassette is automatically selected to supply the stored papers, so that the display of the size display 38 is related to the remaining cassette. This indicates the paper size of the remaining cassette upon changing one of the cassettes.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An automatic paper selector suitable for a copying machine comprising:

first and second paper supply sections to which first and second cassettes storing papers are attached, respectively;

first and second paper extracting means for extracting the papers from the first and second cassettes, respectively, the first and second paper extracting means being positioned at the first and second paper supply sections, respectively; and automatic selecting means for operating said automatic paper selector comprising first and second sensor means for detecting the attachment of said first and second cassette, respectively, first and second differential circuit means responsive to said respective first and second sensor means and connected respectively to a set and a reset input terminal fo a flip-flop means, said flip-flop means being responsive to said first and second differential circuit means for generating set and reset output signals for activating first and second selection lamps, respectively via a first switching circuit means, means for providing said set and reset output signals to a second switching means, said second switching means being responsive to said output signals and to further signals from a CPU for activating either said first or said second paper extracting means associated with the detected first or second cassette.

2. The selector of claim 1, wherein said automatic selecting means activates either said first or second paper extracting means associated with the remaining one of said first and second cassettes upon removal of either said first or second cassettes.

3. The automatic paper selector of claim 1, wherein said automatic selecting means is responsive to the new attachment of either said first cassette or said second cassette for activating either the first paper extracting means or the second paper extracting means, respectively.

4. The automatic paper selector of claim 1, further comprising manual paper selection means, wherein a selection made in response to said sensor means is negated in response to operation of said manual selection means after insertion of both said first and second cassettes.

* * * * *